United States Patent [19]

Webb

[11] 4,133,060

[45] Jan. 9, 1979

[54] ODORLESS TOILET

[76] Inventor: Wayne Webb, 7531 Mountain Ave., Orangevale, Calif. 95662

[21] Appl. No.: 797,948

[22] Filed: May 18, 1977

[51] Int. Cl.[2] ..... E03D 9/052; F04D 25/14; G05D 13/10

[52] U.S. Cl. ..... 4/216; 4/351; 4/352; 137/53

[58] Field of Search ..... 4/209, 213, 214, 215, 4/216, 217, 72, 83, 96, 348–352; 137/53, 55; 98/116, 117

[56] References Cited

U.S. PATENT DOCUMENTS

| | | | |
|---|---|---|---|
| 465,862 | 12/1891 | Kelley | 4/216 |
| 688,234 | 12/1931 | Brown | 4/213 |
| 1,276,965 | 8/1918 | Rowe | 4/216 X |
| 1,564,071 | 12/1925 | Jackson | 4/213 |
| 1,764,493 | 6/1930 | Ball | 137/53 |
| 2,378,178 | 6/1945 | Blazer | 137/53 X |
| 2,677,830 | 5/1954 | Allen et al. | 4/214 |
| 3,942,422 | 3/1976 | Kawai et al. | 137/53 X |

FOREIGN PATENT DOCUMENTS

| | | | |
|---|---|---|---|
| 593766 | 5/1959 | Italy | 4/216 |

*Primary Examiner*—Stuart S. Levy
*Attorney, Agent, or Firm*—Blair, Brown & Kreten

[57] ABSTRACT

Disclosed herein is a means for evacuating the odors associated with toilet use away from the environment of the bathroom and into the sewer. Vent means are provided around the periphery directly below the toilet seat, and impelling means are provided to channel the air traversing through these vents into the sewer outlet remote from the bathroom interior.

2 Claims, 6 Drawing Figures

ODORLESS TOILET

BACKGROUND OF THE INVENTION

Field of the Invention

The concept of venting a bathroom enclosure to remove odors associated with bathroom or toilet use have been known for a long time. However, the traditional means by which this has been brought about has included the use of a vent in the bathroom compartment itself which extends to the atmosphere. This is regarded as an inefficient means for resolving this problem, since the vent necessitates the use of a conduit which is to run from the bathroom enclosure to a point remote therefrom thereby venting into the atmosphere, and this distance can usually be a considerable one.

SUMMARY OF THE INVENTION

Accordingly the following invention overcomes the waste and additional labor involved in providing channels and conduits to provide proper venting in a bathroom enclosure by providing a vent means integral with the toilet which diverts odors associated with toilet use into the sewer pipe which is in proximate relation to the toilet by necessity. This eliminates elaborate conduit networks, and provides an economical means by which problems delignated hereinbefore can be resolved.

OBJECT OF THE INVENTION

Accordingly it is an object of the invention to provide a vent means integral with a toilet to provide positive ventilation.

It is another object of this invention to provide venting means for a toilet in which the vent exhausts into an existing sewer line.

Other objects and advantages will become apparent in the following specification when considered in light of the attached drawings.

DESCRIPTION OF THE PREFERRED EMBODIMENT

Figure 1:
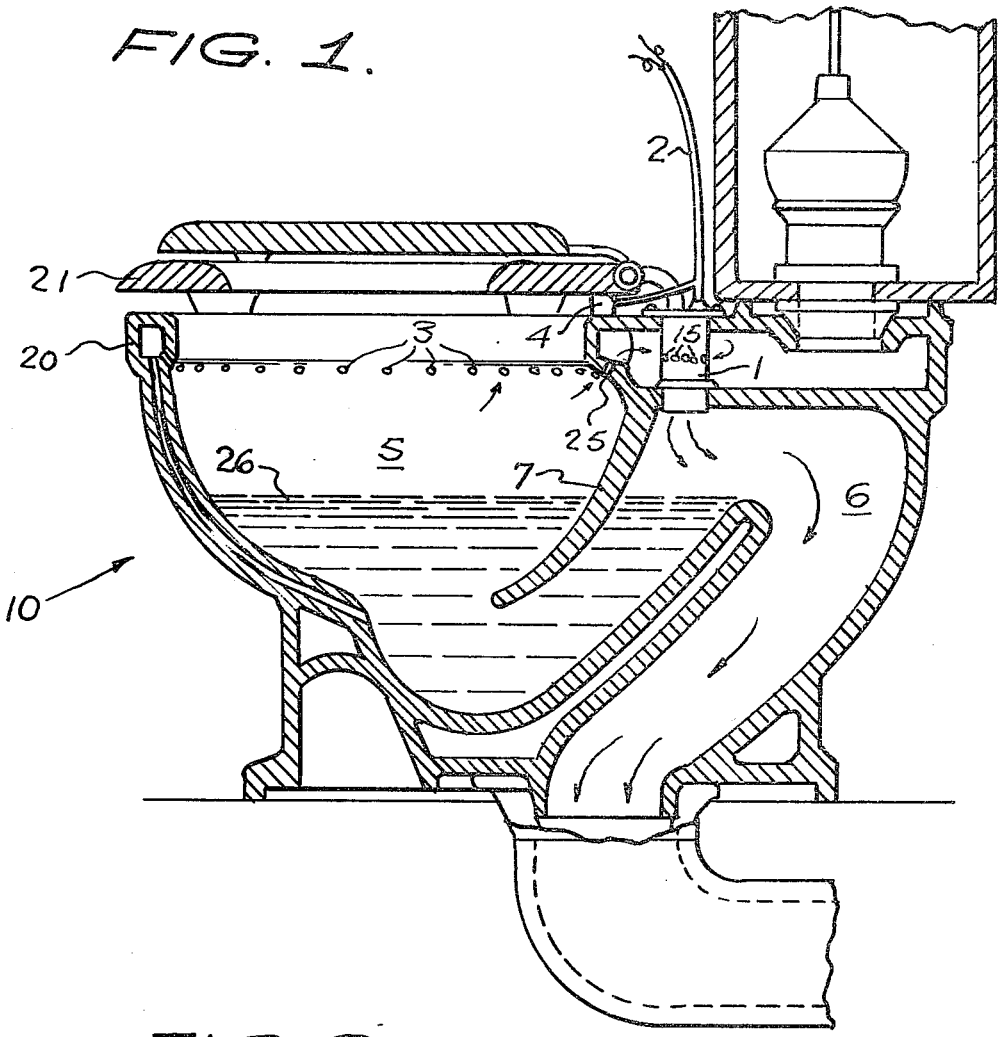
FIG. 1 is a sectional view of a toilet according to the instant invention.
Figure 2:
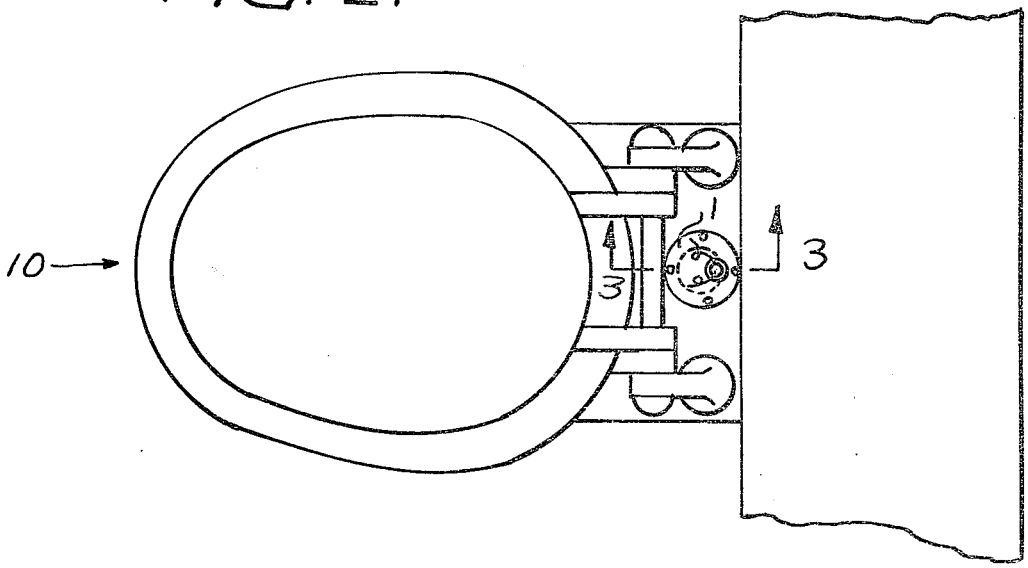
FIG. 2 is a top plan view thereof.

Referring to the drawings now in which like numerals refer to like parts throughout the drawings, numeral 10 generally denotes the toilet assembly.

A toilet can generally be considered of conventional configuration with a few notable exceptions. A plurality of holes 3 are disposed around the inner periphery of bowl 20 which extend to the outside. A switch mechanism 4 is exerted upon the lip of bowl member 20 and when pressure is exerted by weight on the seat 21 the switch will change its condition from off to on. The switch is connected to power line 2 which extends to a conventional AC circuit, and this activates a fan motor 8 which is to be found in housing 1.

Figure 3:
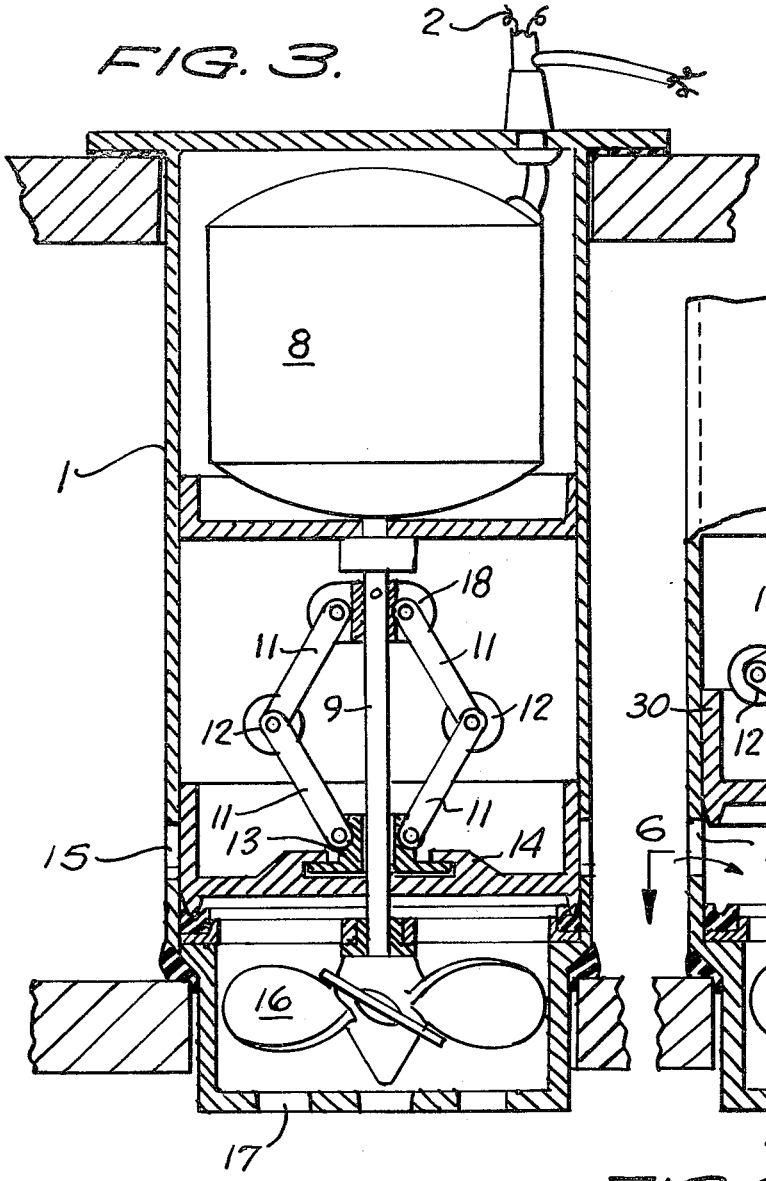
FIG. 3 is a sectional view taken along line 3—3 of FIG. 2.
Figure 4:
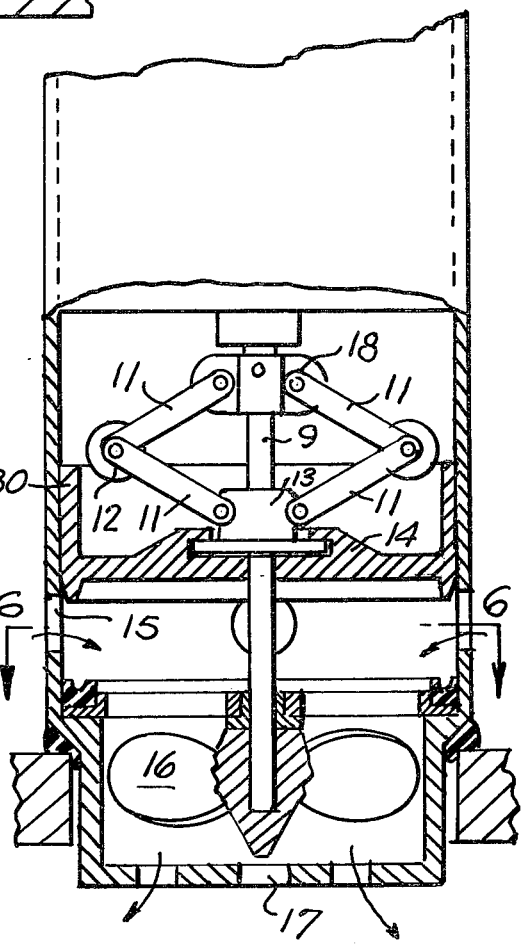
FIG. 4 is a sectional view taken along line 3—3 of FIG. 2 in which the unit is in operation.
Figure 5:
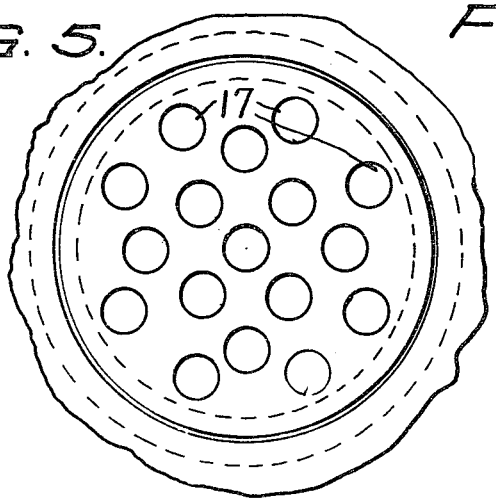
FIG. 5 is a bottom view of the depiction in FIG. 3.
Figure 6:
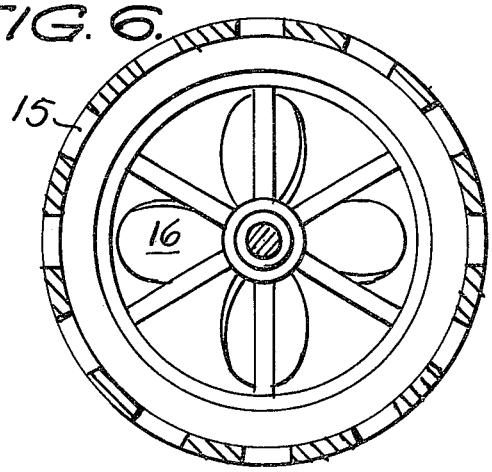
FIG. 6 is a sectional view taken along the line 6—6 of FIG. 4.

FIG. 3 shows the effect of energizing fan 8 in housing 1. As the motor starts to rotate, shaft 9 associated with the motor rotates as well, and impeller means 16 begins to rotate. As the shaft rotation increases, weights 12 which are disposed upon links 11 that are tethered to shaft 9 at collar 18 extend outwardly as best seen in FIG. 4 due to centrifugal force. The effect of these weights extending outwardly is to raise gate 14 which is attached to links 11 through retaining member 13 and has an outer cylindrical annulus portion 30 within casing 1. As gate 14 opens, an air inlet 15 is exposed, which corresponds to the openings of casing 1 shown in FIG. 1. This provides a positive draft circulation in which air contained in chamber 5 of the toilet proceeds through a passageway 25 communicating with fan assembly 1. Air entering the orifices denoted by 15 are drawn through by impeller means 16 and thereafter through orifices 17 located at the lower portion of the fan casing mechanism which is thereafter disposed into the sewer conduit 6 as best seen in FIG. 1. Once odors and gases have been carried to area 6, it is impossible for these odors to seep back. This is true because the water level associated with the toilet denoted by numeral 26 prevents gases from escaping back into the room area by virtue of its inner action with ear member 7 which extends into the water level.

When the seat has become unweighted, the switch 4 returns to an off position, and the fan stops rotating. When this occurs the weights 12 disposed within casing 1 of the fan assembly will return to the position delineated in FIG. 3, and the gate mechanism 14 will return to its rested state. Therefore odors are incapable of seeping back through the fan housing into the toilet area. In view of the foregoing, it will be appreciated that the positive ventilation provided by the structure delineated above provides a means by which venting can be achieved in an economical fashion.

Having thus described the preferred embodiment of the invention it should be understood that numerous structural modifications and adaptations may be resorted to without departing from the spirit of the invention.

What is claimed is:

1. An odorless toilet comprising a toilet area, a sewer area, channel means connecting said toilet area to said sewer area, combined gate and vent means disposed in said channel means whereby when said gate and vent means are energized, ventilation is provided from said toilet area to said sewer area, and when said gate and vent means are deenergized, the channel means is closed; said vent means includes a fan contained in a housing, a shaft connected to said fan, a motor energized by a pressure sensitive switch connected to said shaft, and centrifugal weight means disposed upon said shaft attached to said gate means so that when said motor is energized, the centrifugal weights open said gate means providing ventilation; said toilet area is provided with plural orifices around the upper periphery thereof to provide the ventilation from outside of the toilet area to the inside; said centrifugal weights are disposed upon said shaft by a plurality of links which form a parallelogram; and wherein said gate means is connected to said links through a retaining member which has a disc-like bottom portion and a cylindrical top portion which overlies said shaft and wherein said gate means has a circular lip section which surrounds said disc-like bottom portion, and said lip section continues outwardly to define a circular bottom plate which has a cylindrical annulus portion surrounding said bottom plate to thereby define said gate means and wherein said gate means is slideably disposed within said housing.

2. The device of claim 6 in which said links comprise a four bar linkage in which the terminal portion of two bottom links are connected to said retaining member and wherein the top terminal portion of two top links are connected to a collar fastened to said shaft and wherein said weights are provided at the juncture of the bottom links and top links via pivot means.

* * * * *